US005205980A

United States Patent [19]

Abodishish et al.

[11] Patent Number: 5,205,980

[45] Date of Patent: Apr. 27, 1993

[54] SUBLIMER ASSEMBLY

[75] Inventors: Hani A. Abodishish, Aiken, S.C.; R. James Adams, West Point, Utah

[73] Assignee: Westinghouse Electric Corp., Pittsburgh, Pa.

[21] Appl. No.: 733,525

[22] Filed: Jul. 22, 1991

[51] Int. Cl.[5] ..... C22B 9/02

[52] U.S. Cl. ..... 266/153; 75/618; 75/10.14

[58] Field of Search ..... 266/148, 153; 75/618, 75/10.14

[56] References Cited

U.S. PATENT DOCUMENTS 2,108,118 2/1938 Greenawalt ..... 373/127

4,941,916 7/1990 Boutin et al. ..... 75/10.28

*Primary Examiner*—Melvyn J. Andrews

*Attorney, Agent, or Firm*—J. C. Valentine

[57] ABSTRACT

A sublimer assembly vaporizes zirconium tetrachloride in a Kroll reduction process. A retort for vaporizing the feed has a sidewall extending from a bottom wall with a peripheral heater adjacent to the sidewall and an internal heater extending through the retort. Substantial contact between the feed and the surfaces of the internal heater and retort sidewall is maintained so that the vaporization rate tends to cycle and the time required to vaporize the feed may be substantially reduced.

6 Claims, 2 Drawing Sheets

SUBLIMER ASSEMBLY

BACKGROUND OF THE INVENTION

This invention relates to a sublimer assembly for subliming particulates. It is particularly useful in Kroll reduction processes for vaporizing zirconium tetrachloride, uranium fluoride and the like.

Sublimer assemblies are generally employed in commercial processes to vaporize solids to directly produce vapors for reacting with molten magnesium or sodium. For example, zirconium tetrachloride and hafnium tetrachloride in particulate form are sublimed in commercial Kroll processes so that vapors react with liquid magnesium to form a metal sponge and liquid magnesium chloride. See, e.g., U.S. Pat. No. 4,511,399 which describes sublimers for vaporizing zirconium tetrachloride.

U.S. Pat. No. 4,511,399 describes a production sublimer assembly comprising a retort welded to a lower crucible. The retort generally has a substantially vertical sidewall and a concentric downcomer extending through a bottom wall into the lower crucible. Zirconium tetrachloride particulate feed in the annular volume defined by the sidewall and the downcomer vaporizes, flows down through the downcomer and reacts with liquid magnesium in the lower crucible to form a reduced zirconium sponge in a liquid magnesium chloride pool. The heat to vaporize the zirconium tetrachloride may be provided by a heating means (which is not shown but may be an induction coil of an electric furnace adjacent the sidewall of the retort similar to the coil shown in the patent surrounding the lower crucible or a natural gas furnace). In a typical production cycle, thousands of pounds of zirconium tetrachloride are batch fed into a generally cylindrical retort having a diameter of up to 6 feet or more. The feed may fill the entire annulus between the downcomer and the sidewall up to the top of the downcomer. Typically the height of the particulates exceeds the diameter of the retort. The feed is then heated to at least about 370° C. and vaporized, and a frangible seal in the downcomer is broken to allow the vapors to flow through the downcomer and into the crucible. The feed continues to vaporize at about 370° C. as the reaction in the crucible proceeds at about 850° C.

In practice, the Kroll reduction of zirconium tetrachloride in production facilities requires a long time. In addition, the vaporization rate in the sublimer retort tends to vary substantially during cycles in which the rate is initially high, falls off and then increases. If the cycling could be eliminated, or at least reduced, the cycle time would be reduced.

The applicants theorize that the vaporization rate in the sublimer assembly is heavily (but not entirely) dependent upon thermal conduction into the feed adjacent the retort sidewall. Heat is conducted into the feed in accordance with the basic relationship ($Q = UA(dt)$). The heat transfer coefficient and the temperature differential are reasonably constant in a sublimer. Thus, the principal variable is the heat transfer surface area between the sidewall and the feed. If the surface area changes drastically, then the vaporization rate also changes drastically. The vaporization rate of the feed (which is at about 370° C.) is not uniform across its top surface during the cycle. Rather, the feed adjacent to the sidewall of the retort tends to vaporize first and thereby develop a cone shaped pile of particulate feed having substantially less physical contact with the sidewall. Thus there is substantially less thermal conduction and heat transfer. When the angle of the cone exceeds the angle of repose of the feed, the pile may slump to create a sudden increase in contact area between the retort sidewall and the feed so that the vaporization rate may substantially increase.

Toward the end of the process, the feed may not slump and there is minimal contact between the retort sidewall and the feed. Eventually the feed will only physically contact the retort bottom wall. The cycle time must therefore be greatly extended to vaporize the last portion of the feed.

SUMMARY OF THE INVENTION

It is an object of the present invention to provide a sublimer assembly which vaporizes particulates with less cycling than do presently used assemblies. It is a further object to provide an assembly which vaporizes the particulates more rapidly than do the presently used assemblies.

With these objects in view, the present invention resides in a sublimer assembly for subliming particulates such as zirconium tetrachloride, hafnium tetrachloride and other solids which have an angle of repose of at least about 10°. The assembly has a retort with a substantially vertical sidewall for containing batch fed particulates. A peripheral heater adjacent the sidewall heats the retort and the feed. An interior heater extending through the retort also heats the particulates. In a preferred embodiment of the present invention, the interior heater comprises a plurality of spaced apart open ended pipes extending through the retort. Preferably, the spaced apart pipes extend horizontally in vertically spaced rows of pipes with the adjacent rows extending perpendicularly to each other. Such a structure enables hot gases in the atmosphere surrounding a retort to circulate through the feed so that there is substantially more constant surface area in contact with the feed to generate the vapor even if a cone shaped pile develops. If such a pile eventually slumps against the sidewall of the retort, then there Will be less contact With the surface of the internal heater (during at least part of the cycle) when the cone falls. In addition, it is theorized that the flow of vapor through the feed induced by the internal heater may induce slumping so that a less pronounced cone shape develops.

DESCRIPTION OF THE DRAWINGS

The invention will become more readily apparent from the following description of a preferred embodiment thereof shown, by way of example only, in the accompanying drawings, wherein.

DESCRIPTION OF THE PREFERRED EMBODIMENT

Figure 1:
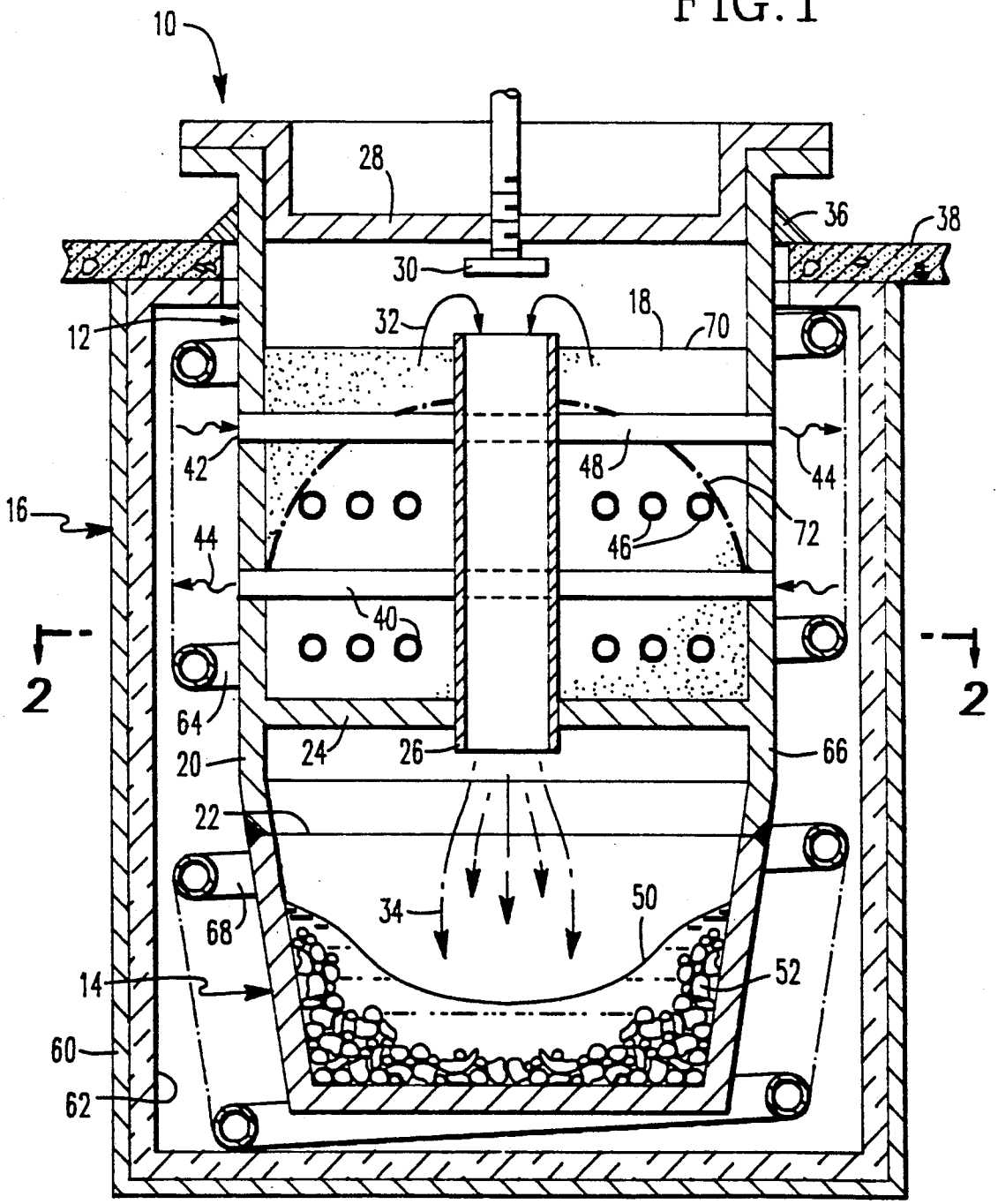
FIG. 1 is a schematic elevation, shown in section, of a sublimer assembly embodying the present invention.
Figure 2:
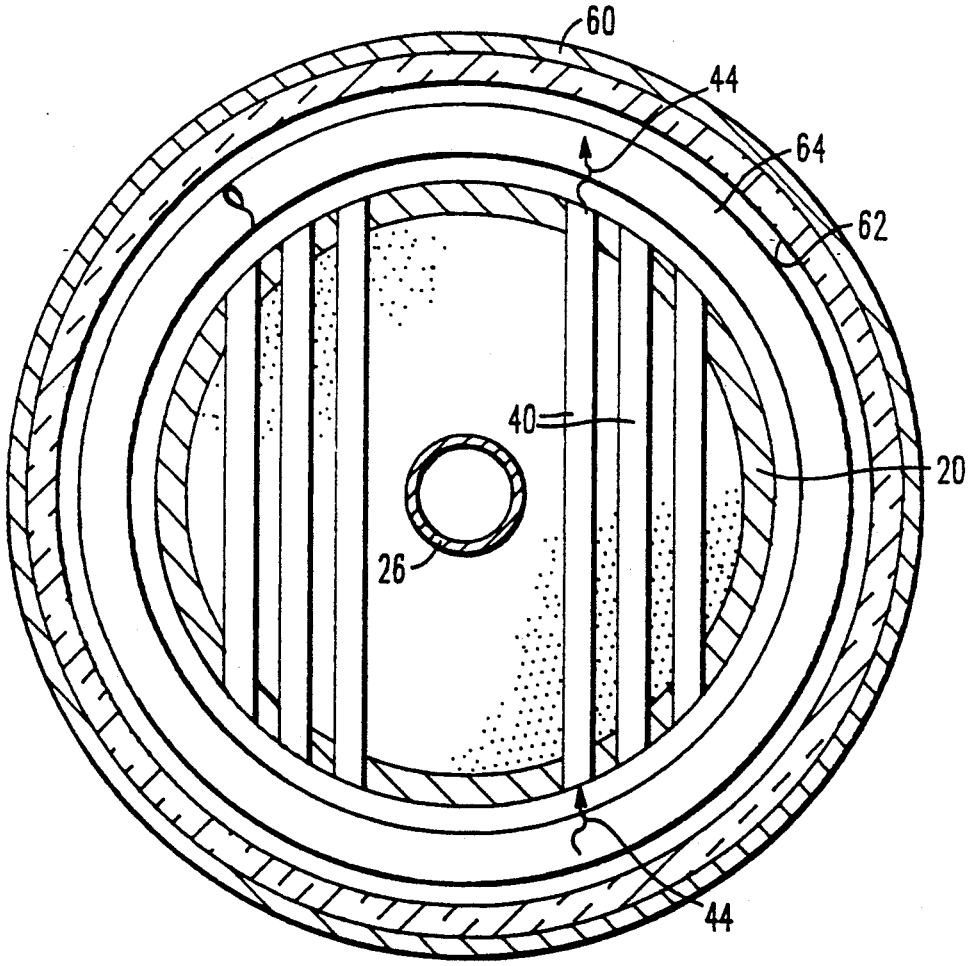
FIG. 2 is a plan section view of the assembly of FIG. 1, taken along section line 2—2.

FIG. 1 generally shows a sublimer assembly 10 including a retort 12, a lower crucible 14 and an electric furnace 16. Other assemblies and a gas fired furnaces may be alternatively employed. The assembly 10 will be described in the context of a Kroll reduction facility for producing zirconium from zirconium tetrachloride, although it may also be employed in other processes where the feed has an angle of repose of at least about 10°.

The retort 12 is shown in the course of a production cycle when zirconium tetrachloride feed 10 is being sublimed. It generally has a cylindrical sidewall 20 extending upwardly from a lower edge 22 and a raised bottom wall 24 with a concentric downcomer 26 extending therethrough. A gas tight lid 28 encloses the retort 12 and supports a rotatable cutter 30. The cutter 30 is initially positioned in the downcomer 26 and eventually raised to break a frangible seal (not shown) in order to allow sublimed vapors to flow into the lower crucible 14 as shown by flow lines 32, 34. The retort 12 may have lugs 36 as shown welded to the sidewall 20 for removably supporting the retort 12 on a concrete floor 38 or other suitable structural support.

The retort 12 has an interior heater for heating and subliming the feed 18. FIG. 1 shows a preferred structure wherein one or more hollow pipes 40 extending from open ends 42 in the retort sidewall 20 are employed. Advantageously hot atmospheric gases in the furnace 16 may circulate through the pipes 40 as is shown by flow lines 44. In another embodiment, resistance heaters (not shown) may be inserted in the pipes 40 before the retort 12 is placed in the furnace 16. FIG. 1 shows a retort 12 employing a grid of pipes 40 wherein there are rows 46 extending in a direction at 90° to alternating rows 48. Preferably the pipes 40 have diameters of at least about ½ inch and are arranged on centers of no more than about one foot between adjacent pipes 40 and adjacent rows 46–48. Also the lowest row 46 is preferably no more than about one foot above the bottom wall 24. Advantageously, such a structure provides a total surface area which is at least equal to the area of the bottom wall 24 and at least about 20% of the surface area of the sidewall 20.

The lower crucible 14 is welded to the lower edge 22 of the retort 12 before the retort 12 is placed in the furnace 16. The crucible 14 is initially charged with magnesium bars and, optionally, recycled magnesium particulates. As shown, the crucible 14 contains flowing zirconium tetrachloride vapors 34 and a liquid pool 50 of magnesium and/or magnesium chloride with a zirconium metal sponge 52 being formed at the bottom of the crucible 14.

The electric furnace 16 under the floor 36 or other supporting structure generally has a wall 60 protected by insulation 62 from the high temperatures of the furnace 16. An induction coil 64 adjacent the outer surface 66 of the retort sidewall 20 is advantageously employed as a peripheral heater to heat the retort 12 and the feed 18 to about 370° C. or more and to vaporize the feed 18. A second induction coil 68 adjacent the lower crucible 14 is advantageously employed as a peripheral heater to heat the crucible 14 and the pool 50 up to about 850° C. or more to support the reaction between the zirconium tetrachloride and the magnesium.

At the beginning of the reaction, the batch feed 18 has an upper surface 70 which is substantially horizontal as shown. In the course of the reaction, the feed 18 would tend to develop a cone shape 72 if internal heaters of the present invention were not employed. The cone shape 72 in large part would be determined by the angle of repose of the feed 18. As the feed 18 adjacent the sidewall 20 vaporized, the cone shape would tend to become steeper until the feed 18 slumped and fell. In the course of the cycle, the surface area of the sidewall 20 in contact with the feed 18 continuously decreases and may then suddenly increase. Such cycling tends to cause erratic flow patterns.

In sublimer assemblies such as the assembly 10 shown by FIG. 1, the feed 10 is in contact with the surface of the pipes 40 if a cone shape develops. If a cone shape does not develop or if a cone slumps, the feed is in contact with more of the retort sidewall. In addition, the presence of internal heating surfaces may cause internal vapor flow which tends to oppose the development of a cone.

While a preferred embodiment of the present invention has been described and shown, as well as certain of its details, advantages and benefits, it is to be distinctly understood that the invention is not limited thereto but may be otherwise variously embodied within the scope of the following claims.

We claim:

1. A sublimer assembly for vaporizing particulates, comprising:

a retort having a sidewall extending from a bottom wall for containing particulates, the sidewall having an outer surface;

a peripheral heater adjacent the outer surface of the side wall;

an interior heater extending through the retort, the interior heater having a plurality of spaced apart members on maximum centers of about one foot from each other, the members having a total surface area of at least about 20% of the surface area of the sidewall of the retort.

2. The assembly of claim 1, wherein the interior heater comprises a hollow member extending from the sidewall.

3. The assembly of claim 2, wherein the hollow member has open ends extending from the sidewall.

4. The assembly of claim 3, wherein a plurality of hollow members extend through the retort.

5. The assembly of claim 4, wherein the hollow members are open ended pipes extending through the sidewall.

6. The assembly of claim 1, wherein the members have a total surface area greater than the surface area of the bottom wall of the retort.

* * * * *